US007293336B2

(12) United States Patent
Fleissner

(10) Patent No.: US 7,293,336 B2
(45) Date of Patent: Nov. 13, 2007

(54) METHOD FOR CONSOLIDATING A MATERIAL WEB MADE FROM WOOD PULP

(75) Inventor: Gerold Fleissner, Zug (CH)

(73) Assignee: Fleissner GmbH, Egelsbach (DE)

( * ) Notice: Subject to any disclaimer, the term of this patent is extended or adjusted under 35 U.S.C. 154(b) by 523 days.

(21) Appl. No.: 10/478,974

(22) PCT Filed: May 24, 2002

(86) PCT No.: PCT/EP02/05697

§ 371 (c)(1),
(2), (4) Date: Jun. 17, 2004

(87) PCT Pub. No.: WO02/097181

PCT Pub. Date: Dec. 5, 2002

(65) Prior Publication Data

US 2004/0221437 A1 Nov. 11, 2004

(30) Foreign Application Priority Data

May 30, 2001 (DE) ..... 101 26 515

(51) Int. Cl.
*D04H 1/46* (2006.01)

(52) U.S. Cl. ..... 28/104

(58) Field of Classification Search ..... 28/104, 28/105, 167, 103; 442/408, 409, 412, 413, 442/385, 387; 156/148; 162/103, 108, 109, 162/115, 202–204

See application file for complete search history.

(56) References Cited

U.S. PATENT DOCUMENTS 3,485,706 A * 12/1969 Evans ..... 428/134
3,994,047 A * 11/1976 Lee et al. ..... 28/104
4,755,421 A * 7/1988 Manning et al. ..... 442/338
5,128,082 A * 7/1992 Makoui ..... 264/112
5,137,600 A * 8/1992 Barnes et al. ..... 162/115
5,389,202 A * 2/1995 Everhart et al. ..... 162/103
6,022,818 A * 2/2000 Welchel et al. ..... 442/384
6,110,848 A 8/2000 Bouchette
6,836,937 B1 * 1/2005 Boscolo ..... 28/104
6,836,938 B2 * 1/2005 Fleissner ..... 28/104
2003/0024092 A1 * 2/2003 Orlandi ..... 28/104
2003/0213108 A1 * 11/2003 Strandqvist ..... 28/104
2005/0278912 A1 * 12/2005 Westland et al. ..... 28/104

FOREIGN PATENT DOCUMENTS

EP 0 483 816 5/1992
EP 0 492 554 7/1992

* cited by examiner

*Primary Examiner*—A. Vanatta
(74) *Attorney, Agent, or Firm*—Antonelli, Terry, Stout & Kraus, LLP.

(57) ABSTRACT

Production of a non-woven tissue from wood pulp on a wet strip is known. The above has a cardboardy, paper-like feel to it. In order to achieve a web with sufficient resilience, the desired wood pulp fibres used to advantage in the hygiene industry for absorbing liquids are thus always mixed with chemical fibres as support fibres. According to the invention, a consolidated tissue with a soft feel and high fluid absorption is obtained by means of needling a non-woven pure wood pulp tissue with water.

8 Claims, No Drawings

METHOD FOR CONSOLIDATING A MATERIAL WEB MADE FROM WOOD PULP

EP-A-0 359 615 discloses a method for forming a fabric web only from cellulose fibers such as wood pulp, which web is formed by a wet process and then only dried. Strengthening in the sense of an intertwining of the fibers with one another does not take place there.

EP-A-0 308 320 teaches the preparation of a more highly strengthened fabric web by feeding onto a fabric web made of wet-laid endless filaments a further ply made of up to 90% wood pulp mixed with staple fibers. Both together are then strengthened by hydrodynamic needling.

A similar method is disclosed in EP-A-0 373 974, according to which wet-laid webs made of up to 80% wood pulp are likewise hydrodynamically needled together with webs, now of staple fibers. Such composites do have higher strength, but the capacity for absorbing liquids is unsatisfactory.

The forming of these composites by a dry process is likewise known. In connection with filaments, reference is made to EP-A-0 492 554, where a cellulose content of up to 90% is water-needled with the filaments.

In contrast, U.S. Pat. No. 6,110,848 views a composite as advantageous if the wood pulp ply, with a thickness of up to 90%, has an underply made of a nonwoven fabric made of carded staple fibers between 30 and 100 mm. A third nonwoven fabric made of such staple fibers on top, with the wood pulp ply in the middle, can complete the composite. Everything together is to be hydrodynamically strengthened.

Such composites are advantageous in many application situations, but the manmade fibers that are held to be necessary do not absorb any moisture, for which reason a further product is sought that likewise has adequate strength.

The goal of the invention is therefore to find a method for manufacturing a nonwoven fabric that has the greatest possible liquid absorption capacity and additionally has a sufficient strength to guarantee that the nonwoven fabric can be used in the application situations in question.

In any case it is certain that the nonwoven fabric made of wood pulp is to be formed by a dry formation process, for example is to be deposited dry on an endless belt by an air laying process and strengthened in the usual manner by suction on the endless belt. Then, for strengthening, the pure wood pulp web, that is, a fabric web formed from 100% wood pulp fibers, need only be subjected to hydrodynamic needling and then dried.

As experimental conditions, moistening of the wood pulp fibers between two endless belts with a water pressure of 10 bar was selected first. The actual strengthening needling was then carried out in a single-sided or two-sided manner with a water pressure of only 20 bar. The water pressure should not be chosen too high; a pressure of 15-40 bar is advantageous. The screen selected for support during needling should have only a slight permeability of some 10% open area in order to control pulp loss.

Surprisingly, it was found that the feared wood pulp loss during water needling under these conditions is not very significant. Specifically, this is the subject of WO 01/14624, where along with the carrier ply made of chemical fibers, a ply made of melt-blown fibers is fed initially before the metering of the wood pulp fibers onto the chemical-fiber carrier ply, in order to reduce the wood pulp loss during subsequent hydrodynamic strengthening.

The wood pulp fibers have a length of 1-5 mm. The length depends on the tree, on the species of plant. A nonwoven fabric preferred here should in any case have fibers varying in length, preferably also fibers longer than 5 mm. Surprisingly, it was found that these only short fiber lengths can be entangled with water-jet strengthening so that a nonwoven fabric strengthened in all dimensions can come about.

Before drying, the wet and strengthened wood pulp nonwoven fabric can further be sprayed with a binder before it is then dried immediately afterward.

Of course, the wood pulp web so strengthened can also be blended with other fibers after water needling or bonded to another web made of different fibers such as staple fibers or filaments or also natural fibers.

The invention claimed is:

1. Method for strengthening a fiber web formed from wood pulp, comprising forming a fabric web consisting essentially of a pure wood pulp ply formed from 100% wood pulp fibers by dry laying wood pulp on an endless belt by a dry formation method, hydrodynamically needling the fabric web consisting essentially of the pure wood pulp ply from both sides for strengthening and then drying the fabric web.

2. Method according to claim 1, further comprising moistening the wood pulp ply with a water pressure of between 15 and 50 bar before the hydrodynamic needling.

3. Method according to claim 1, further comprising before drying and after hydrodynamic needling, feeding a binder onto the strengthened fabric web.

4. Method according to claim 1, further comprising bonding a separate ply having a small content of staple fibers or filaments, or natural fibers to the strengthened wood pulp ply in order to form a composite.

5. Method according to claim 4, wherein the separate ply is laid onto or under the wood pulp ply.

6. Method according to claim 5, wherein the wood pulp ply is water-needled, together with the separate ply.

7. Method according to claim 2, further comprising before drying and after hydrodynamic needling, feeding a binder onto the strengthened fabric web.

8. Method according to claim 4, wherein the wood pulp ply is water-needled, together with the separate ply.

* * * * *